United States Patent [19]

Kodama et al.

[11] 4,454,908

[45] Jun. 19, 1984

[54] CONTINUOUS CASTING METHOD

[75] Inventors: Hideyo Kodama; Eisuke Niyama, both of Katsuta; Munehiro Endo; Tomoaki Kimura, both of Hitachi, all of Japan

[73] Assignee: Hitachi, Ltd., Tokyo, Japan

[21] Appl. No.: 351,658

[22] Filed: Feb. 24, 1982

[30] Foreign Application Priority Data

Feb. 27, 1981 [JP] Japan ..... 56-27027

[51] Int. Cl.[3] ..... B22D 11/16; B22D 11/06

[52] U.S. Cl. ..... 164/454; 164/413; 164/482; 164/484

[58] Field of Search ..... 164/454, 482, 413, 433, 164/484

[56] References Cited

U.S. PATENT DOCUMENTS 4,212,344 7/1980 Uedaira ..... 164/423

FOREIGN PATENT DOCUMENTS 54-135624 10/1979 Japan ..... 164/433

55-97857 7/1980 Japan ..... 164/413

*Primary Examiner*—Gus T. Hampilos

*Assistant Examiner*—Richard K. Seidel

*Attorney, Agent, or Firm*—Thomas E. Beall, Jr.

[57] ABSTRACT

A continuous casting method in which molten metal is continuously poured into a moving mould cavity formed between a rotary casting wheel having a peripheral casting groove and a moving belt partially covering the peripheral casting groove. The cast billet which has been solidified at least outer surfaces thereof is continuously pulled out from the moving mould cavity by means of pinch rollers which are rotated at a peripheral speed greater than that of the rotary casting wheel.

15 Claims, 5 Drawing Figures

CONTINUOUS CASTING METHOD

BACKGROUND OF THE INVENTION

The present invention relates to a continuous casting method and, more particularly, to a continuous casting method in which molten metal is poured into a moving mould cavity formed between a casting rotary wheel provided with a peripheral casting groove and a belt contacting the outer periphery of the rotary wheel and covering a part of the casting groove, and the casting solidified at least at its surfaces is continuously pulled out from the moving mould cavity.

When a metal such as, for example, an iron alloy is cast by this continuous casting method, the core portion of the casting does not solidify at the outlet of the moving mould cavity, because of the low heat conductivity of the iron alloy. The pulling out of the casting from the moving mould cavity, therefore, tends to cause a cracking in the inner surface of the solidified shell of the casting. In the worst case, the crack develops to reach the surface of the casting to permit the unsolidified molten metal to flow out through the crack.

In order to avoid the undesirable cracking in the casting during pulling out, it has been proposed to make the peripheral speed of the casting wheel and the peripheral speed of the pinch roller coincide with each other as disclosed, for example, in Japanese Patent Laid-open 135624/1979.

SUMMARY OF THE INVENTION

Objects of the Invention

Accordingly, an object of the invention is to provide a continuous casting method improved to obviate the undesirable cracking in the casting when the latter is pulled out of the moving mould cavity.

Statement of the Invention

To this end, according to the invention, there is provided a continuous casting method in which a molten metal is poured into a moving mould cavity formed between a rotary casting wheel provided with a peripheral casting groove and a belt contacting the outer periphery of the rotary casting wheel so as to cover a part of the casting groove, and the casting solidified at least at its outer surfaces is continuously pulled out from the moving mould cavity by means of pinch rollers, characterized in that the pinch rollers are rotated at a peripheral speed higher than the peripheral speed of the rotary casting wheel thereby to impart a tension to the pulled casting.

In the continuous casting method using a rotary casting wheel and a belt which in combination form a moving mould cavity, the molten metal is continuously poured into the moving mould cavity from a tundish through a nozzle while rotating the rotary wheel, thereby to continuously produce a billet as a casting. In order to maintain a constant level of the molten metal in the moving mould cavity, it is necessary to delicately adjust the peripheral speed of the rotary casting wheel because the rate of pouring of the molten metal through the nozzle is varied due to clogging of the nozzle and other reasons. An inadequate adjustment of the peripheral speed of the rotary casting wheel may cause various inconveniences such as overflow of the molten metal, fluctuation in the cooling time and so forth. The adjustment of the peripheral speed of the rotary casting wheel in turn requires an adjustment of the peripheral speed of the pinch rollers in accordance with the change in the peripheral speed of the rotary casting wheel. The cracking in the strip cannot be avoided perfectly even if the peripheral speed of the rotary wheel is adjusted to maintain a constant level of the molten metal while maintaining coincidence between the peripheral speed of the rotary casting wheel and that of the pinch rollers.

The present inventors have made a minute study as to the cause of this cracking and found that the cracking is attributable to the fact that the billet is pulled out with non-uniform thickness of the solidification shell thereof. More specifically, the molten metal contracts when it is solidified. In the continuous casting of the kind described, the molten metal exhibits different extents of solidification contraction at its side facing the belt and at its side facing the rotary casting wheel. The extent of solidification contraction fluctuates even in one side of the billet e.g. the side facing the rotary casting wheel, due to variation of surface condition of the casting groove, variation in the wall thickness of the rotary casting wheel and other reasons. Namely, it is materially impossible to obtain a uniform solidification contraction of the molten metal over the entire surface of the casting groove. Since the extent of solidification contraction differs depending on the position in the casting mould, gaps are formed here and there between the cast billet and the casting mould. The portion of the molten metal where the gap exists solidifies at a rate smaller than that in the portion directly contacting the casting mould. In consequence, the thickness of the solidification shell of the cast billet when the latter is pulled out from the mould cavity is fluctuated in a wave-like manner. As this cast billet is pulled continuously, bending stress is concentrated to the portions where the thickness of the solidification shell is small, thereby to cause cracking in such portions.

The present inventors have found that, by making the speed of pulling out of the cast billet greater than the speed of feed of the billet by the rotary casting wheel so as to forcibly bring the cast billet into contact with the bottom surface of the casting groove, it is possible to substantially uniformalize the thickness of the solidification shell facing the bottom of the casting groove.

By making the peripheral speed of the pinch rollers greater than the peripheral speed of the rotary casting wheel, a tension is imparted to the cast billet to press the latter onto the surface of the bottom of the casting groove. This in turn reduces the tendency of formation of gaps between the cast billet and the casting mould to ensure a substantially constant solidification speed in the molten metal at the side of the latter facing the bottom of the casting groove. Furthermore, since the length of contact between the molten metal and the casting mould is increased, the effect of cooling of the molten metal is increased to increase the thickness of the solidification shell. It proved also that the increased contact length offers another advantage of correction of non-uniformity of the shell thickness at the portion of increase of the contact length.

According to the continuous casting method of the invention, the cast billet is pulled out of the casting mould with uniform thickness of the solidification shell particularly at the side of the billet facing the bottom of the casting groove. In consequence, the bending stress is uniformly disposed to eliminate the undesirable cracking in the cast billet.

According to the invention, the peripheral speed of the pinch roller is selected to be 102 to 110% of the peripheral speed of the rotary casting wheel. The lower limit speed, i.e. the speed amounting to 102% of the peripheral speed of the rotary casting wheel, is a value supported by an experiment. If the peripheral speed of the pinch roller is selected to be smaller than this speed, there is the tendency of cracking in the inner surface of the solidification shell when the cast billet is pulled out of the moving mould cavity. To the contrary, a peripheral speed in excess of 110% of that of the rotary casting wheel applies an excessively large tension to the solidification shell to undesirably tear and break the cast billet. More preferably, the peripheral speed of the pinch roller is selected to fall between 103 and 107% of the peripheral speed of the rotary casting wheel.

The present invention produces a remarkable effect particularly when it is applied to continuous casting of iron or iron alloy, because, in the cast billet of the iron or iron alloy, the core portion of the billet is still in the molten state when the billet is pulled out of the moving mould cavity. The term "iron alloy" is used here to mean generally an alloy based on iron, i.e. an alloy in which the greater part is occupied by iron. The present invention is most suitably applied to the continuous casting of such iron alloys as adapted to make a transformation from $\delta$ to $\gamma$ in the course of the cooling step, among the iron alloys as defined above. Typical examples of iron alloys to which the invention can be applied most suitably are iron-manganese alloy, iron-silicon alloy, carbon steel having a carbon content of between 0.1 and 0.5 wt. % and so forth.

The advantages of the invention will be described hereinunder on an assumption that the invention is applied to the continuous casting with a carbon steel containing 0.1 to 0.5 wt. % of carbon steel. Such a carbon steel exhibits a transformation to $\delta$ in the course of the cooling and $\delta$ is further transformed into $\gamma$. A large solidification contraction is caused during transformation from $\delta$ to $\gamma$. The rate of transformation from $\delta$ to $\gamma$ varies delicately depending on the condition of inner surface of the casting mould. Namely, the transformation takes place earlier in the portion where the transfer of heat to the casting mould is made at a large rate than in the portion where the transfer of heat is made at a small rate. This tends to generate a gap between the cast billet and the casting mould and to cause a lack of uniformity of the thickness of the solidification shell. The speed of pulling out of the cast billet can be adjusted by detecting the driving torque of the wheel driving motor from the value of the electric current and adjusting the peripheral speed of the rotary casting wheel such that the driving torque follows up the command value in relation to the level of the molten metal, while adjusting the peripheral speed of the pinch rollers such that it ranges between 102 to 110% of the peripheral speed of the rotary wheel.

Figure 1:
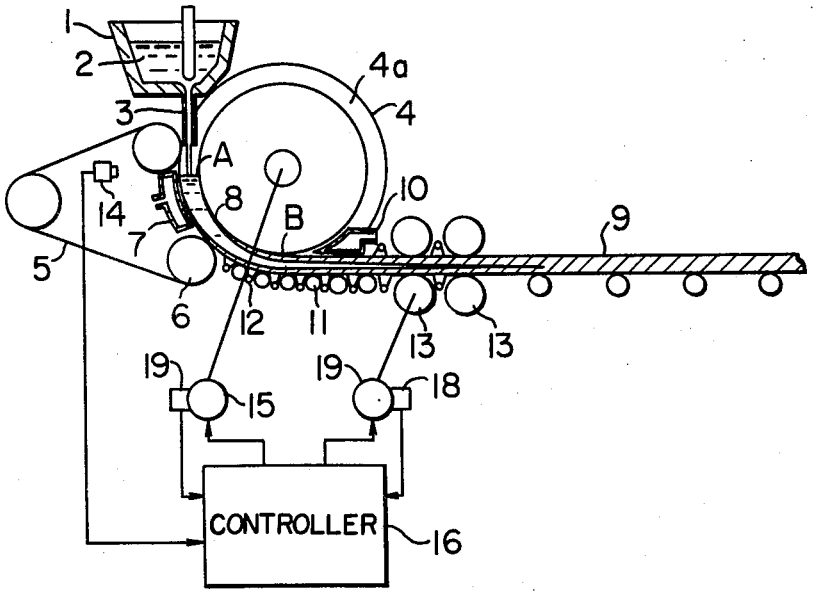
FIG. 1 is a schematic illustration of a continuous casting apparatus.

EXAMPLES:

Referring to FIG. 1 schematically showing a continuous casting apparatus, a moving mould cavity is formed between a rotary casting wheel 4 having a peripheral casting groove 4a and an endless metal belt 5 which is suitably tensed by a pulley 6. A molten metal 2 held by a tundish is poured through a nozzle 3 into the moving casting mould. The belt 5 is cooled by means of a water-cooling device 7 having a water spray port. The heat of the molten metal is transferred to the rotary casting wheel 4 and the endless metal belt 5 so that the molten metal is gradually cooled to solidify at its surfaces to form a solidification shell 8. Thus, the thickness of the solidification shell 8 is gradually increased as the moving mould cavity is moved in accordance with the rotation of the rotary casting wheel.

At the outlet of the moving mould cavity at which the cast strip 9 is separated from the rotary casting wheel, disposed are a water-cooled knife 10, levelling rollers 11 and spray nozzles 12. The knife 10 serves to separate the cast billet 9 from the rotary casting wheel 4, while the levelling rollers 11 are adapted to level the bent billet separated from the rotary casting wheel. The levelled billet is also cooled by means of the spray nozzles 12. The levelled and cooled cast billet 9 is then pulled by means of pinch rollers 13 which are rotated at a peripheral speed greater than that of the rotary casting wheel and cooled and solidified completely to its core to become a cast billet which is then forwarded to a subsequent step of process.

An explanation will be made hereinunder as to the driving system for driving the rotary casting wheel 4 and the pinch rollers 13. At the time of starting of the casting, a dummy bar is inserted into the mould cavity to receive the molten metal. Then, the rotary casting wheel 4 and the pinch rollers 13 are rotated at speeds corresponding to the rate of pouring of the molten metal, and the dummy bar is withdrawn. Then, the wheel driving motor 15 is controlled by means of a controller 16 in accordance with the output from a molten metal level detector 14 in such a manner as to maintain a constant level of the molten metal. The electric currents supplied to the pinch roller driving motor 17 and the wheel driving motor 15 are detected by respective electric current detectors 18 and 19.

The detail of the controller 16 will be explained in connection with FIG. 2. The electric currents detected by respective current detectors 18 and 19 are supplied to respective low-pass filters where the fluctuation components due to acceleration and deceleration are eliminated. The outputs from respective low-pays filters are delivered to comparators where these outputs are compared with set values which are set, respectively, by reference current setting devices. Suitable reference currents are set beforehand in these current setting devices. More specifically, the current value set in the reference current setting device for pinch roll motor 17 is selected to be 102 to 110% of the current set in the reference current setting device for wheel motor 15. The outputs from the comparators, i.e. the differences between the detected currents and the reference currents set in the reference current setting devices, are delivered to respective speed instruction devices which are adapted to issue instructions depending on whether the differences are positive or negative and in accordance with the magnitudes of the differences so as to make the detected currents coincide with the reference currents. The speed instruction devices on the other hand receive the output from the level detector 14 so as to effect the speed control to make the molten metal surface coincide with the reference level. The speed instructions are given to respective speed controllers of the motors 17 and 15 so that the motors are operated at speeds corresponding to the speed instructions.

A practical example of operation of the speed controller will be explained on an assumption that the speed instruction for the casting wheel is so high that a compression force is applied to the cast billet. In such a case, the load torque imposed by the casting wheel becomes large to reduce the speed of the wheel driving motor. The speed controller, which is adapted to maintain the instructed speed by increasing or decreasing the electric current, operates in this case to increase the electric current supplied to the wheel driving motor to recover the speed of the casting wheel. The increased electric current is detected by the current detector 19 and is compared by the comparator with the reference current. Since in this case the detected current is greater than the reference current, the difference takes a positive value which is applied to the wheel speed instruction device. The speed instruction device 24 then issues an instruction for decreasing the speed of the casting wheel thereby to make the electric current supplied to the motor coincide with the reference current. On the other hand, the pinch roller driving motor receives an instruction for increasing the speed due to the same principle, thereby to make the electric current supplied to this motor coincide with the reference current.

Figure 2:
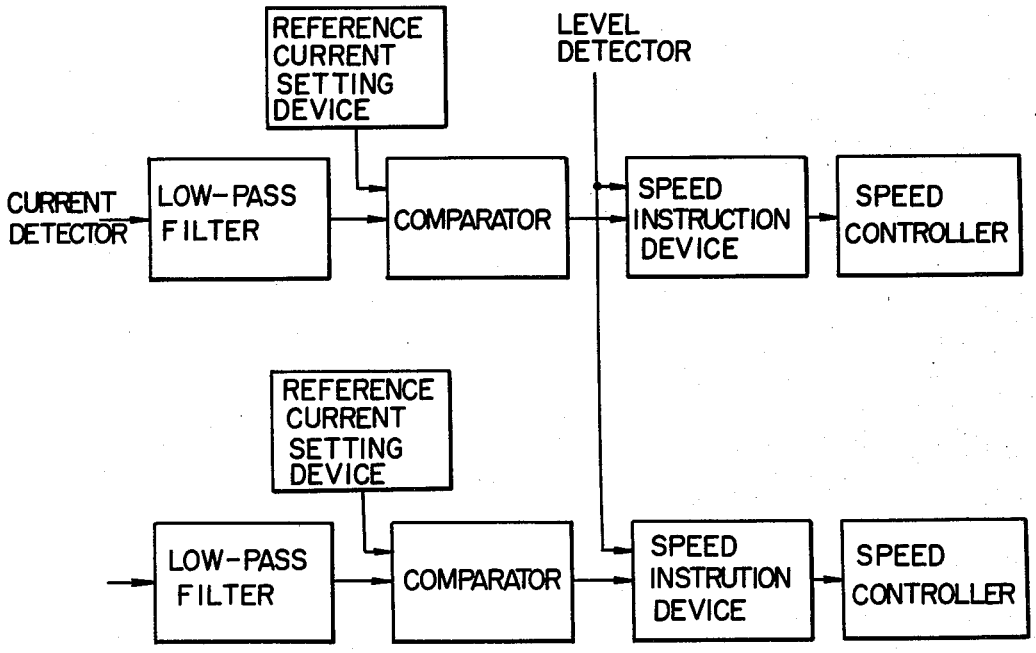
FIG. 2 is a block diagram of a speed controller.

An experimental casting was conducted with the casting apparatus constructed as shown in FIGS. 1 and 2. An ordinary structural rolled steel (JIS G3101 SS41) was melt in an electric furnace (not shown) and was charged into a tundish. The molten steel was then poured into the moving mould cavity at a temperature of 1560° C., while driving the pinch rollers at a peripheral speed which is 103% of that of the rotary casting wheel. The level of the molten steel was set at a height which is 70 mm below the level of axis of the rotary casting wheel. The rotary casting wheel was made of a copper alloy containing about 1 wt. % of silver and had a diameter of 3 m. The mould cavity had a trapezoidal cross-section. The width of the peripheral casting groove was 190 mm at the bottom and 160 mm at the open end. The height or depth of the groove was 130 mm. The pinch rollers and the pulley 6 were made of a tool steel. The belt was made of a low-carbon steel to have a thickness of 2.6 mm and a width of 280 mm. The nozzle was made of silica.

By way of reference, castings were conducted while driving the pinch rollers at a peripheral speed equal to that of the rotary casting wheel and driving the rotary casting wheel at a peripheral speed 2% greater than that of the pinch rollers, respectively.

Figure 3:
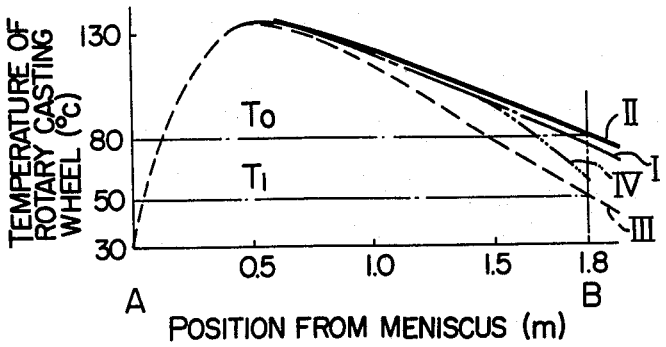
FIG. 3 is a graph showing how the temperature of the rotary casting wheel is changed between the position of the molten metal surface and the levelling position.

FIG. 3 shows how the temperature of the rotary casting wheel just under the mould is changed between the position A of the molten metal surface and the levelling position B, i.e. the point where the cast billet leaves the rotary casting wheel. In FIG. 3, a curve I shows the temperature characteristics as observed in the casting method of the invention. The temperature characteristics shown by the curve I well approximates the temperature characteristics shown by a curve II which is drawn on an assumption that the cast billet is maintained in a perfect contact with the moving casting mould. It is, therefore, understood that, in the casting method of the invention, the cast strip is maintained in good contact with the moving casting mould thanks to the tension imparted to the cast billet due to the difference between the peripheral speed Vp (m/min.) of the pinch rollers and the peripheral speed Vw (m/min.) of the rotary casting wheel. The above-mentioned curve II representing the temperature characteristics expected when the cast billet is held in perfect contact with the casting mould, i.e. when there is no air gap between the cast billet and the casting mould, has been obtained through calculation.

When a straightening levelling is effected on the cast billet under the presence of compression stress, the temperature $T_l$ of the rotary casting wheel at the levelling position B as shown by a curve III is considerably lower than the rotary casting wheel temperature $T_o$ of the temperature characteristics II. This means that the contact between the cast billet and the moving casting mould is imperfect.

A curve IV shows the temperature characteristics observed when the pinch rollers are driven at the same peripheral speed as the rotary casting wheel. The temperature characteristics represented by the curve IV well conform with the characteristics as observed in the method of the invention up to a point immediately before the levelling point B. Then, the rotary casting wheel exhibits a drastic temperature drop. This means that the cast billet is held in good contact with the casting mould up to the point where the drastic temperature drop starts and thereafter, the contact between the cast billet and the casting wheel has failed.

Figure 4:
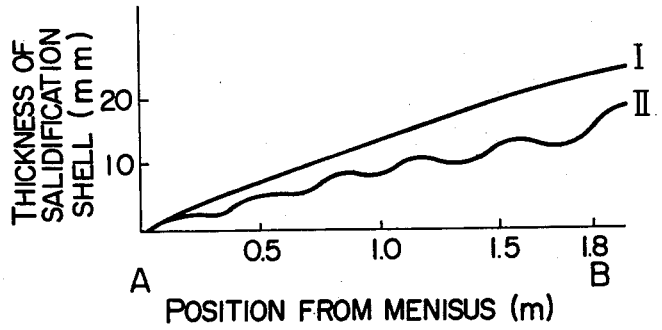
FIG. 4 is a graph showing how the thickness of the solidification shell of a cast billet is changed as the molten metal is moved from the surface level to the levelling position.

FIG. 4 shows how the thickness of the solidification shell is changed as the molten metal is moved from the pouring position, i.e. position of the molten metal surface A, to the levelling position B. As will be understood from a curve I in FIG. 1, the thickness of the solidification shell is increased at a constant rate without fluctuation in the casting method of the invention. Thus, according to the casting method of the invention, it is possible to obviate the undesirable oscillatory change of the solidification shell thickness in the region between the position of the molten metal surface A and the levelling position B, so that the local concentration of the tensile strain to some portions of the inner surface of the solidification shell is obviated. It is, therefore, possible to straighten and level the cast billet without being accompanied by the internal cracking in the cast billet. On the other hand, in the conventional case of the characteristic curve II, internal cracking was observed at the portions where the thickness of the solidification shell is small, due to the fluctuation of the solidification shell thickness attributable to the non-uniform contact between the cast billet and the casting mould.

As has been described, according to the invention, the cast billet is suitably tensioned to eliminate the formation of gaps between the cast billet and the casting mould thereby to achieve a good contact therebetween. In order to determine the optimum range of the tension applied to the cast billet, the present inventors have conducted an experimental casting with various values of the ratio of the periperal speed Vp (m/min.) of the pinch rollers to the peripheral speed Vw (m/min.) of the rotary casting wheel. The temperature of the bottom of the casting mould at the levelling position B was used as the parameter representing the state of contact between the cast billet and the moving mould cavity. The result of this experiment is shown in FIG. 5.

Figure 5:
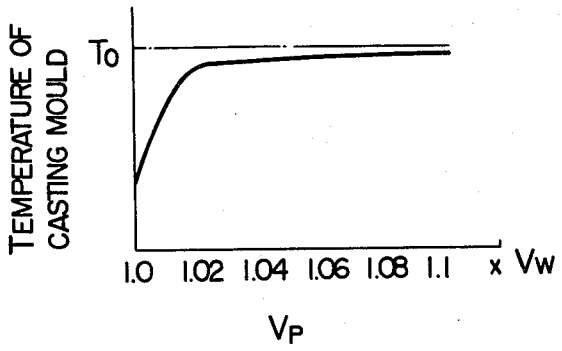
FIG. 5 is a graph showing how the temperature of the casting mould is changed in relation to the ratio between the peripheral speed Vp of the pinch roller and the peripheral speed Vw of the rotary casting wheel.

Referring to FIG. 5, when the pinch rollers are operated at a peripheral speed Vp (m/min.) equal to that Vw (m/min.) of the rotary casting wheel, the mould temperature is low as compared with the temperature To which is obtained when the cast billet is held in good contact with the casting mould. This means that the generation of the gaps cannot be suppressed sufficiently when the pinch rollers are operated at the same peripheral speed as the rotary casting wheel. In order to eliminate the gap to make the casting mould temperature approximate the temperature To, it is preferred to select the peripheral speed Vp (m/min.) to be about 102% of the peripheral speed Vw (m/min.) As the peripheral speed Vp (m/min.) of the pinch rollers is increased beyond 102% of the peripheral speed Vw (m/min.) of the rotary casting wheel, the temperature of the casting mould is gradually increased to approach To. However, if the peripheral speed Vp (m/min.) becomes higher than 110% of the peripheral speed Vw, the tension applied to the cast strip becomes excessively large to cause a rapid wear of the casting mould and to increase the tendency of breakage or rupture of the solidification shell because the latter cannot withstand such a large tension. For these reasons, the peripheral speed Vp (m/min.) of the pinch rollers is selected to range between 102% and 110% of the peripheral speed Vw of the rotary casting wheel. In order to fully enjoy the advantage of the invention, it is more preferable to select the peripheral speed Vp (m/min.) of the pinch rollers to range between 103 and 108% of the peripheral speed Vw (m/min.) of the rotary casting wheel.

EXAMPLE 1

25 tons of molten SS41 steel (JIS G 3103) maintained at 1560° C. was poured for 40 minutes into a moving mould cavity having a trapezoidal cross-section of a depth of 130 mm and widths of 160 mm and 190 mm at the upper end and lower end, respectively. The rotary casting wheel was rotated at a peripheral speed of 3.0 m/min. while the pinch rollers were operated at a peripheral speed of 3.1 m/min. which is about 103% of that of the rotary casting wheel, to pull out the cast billet from the moving mould cavity. The steel billet thus formed was examined and proved to have a good quality without any internal crack.

EXAMPLE 2

25 tons of welding structural rolling steel corresponding to SM 50 A (JIS G 3106) in the molten state, maintained at 1545° C., was poured for 35 minutes into the moving mould cavity having the same shape and size as the Example 1. The rotary casting wheel was driven at a peripheral speed of 4.2 m/min. while the pinch rollers were operated at a peripheral speed of 4.5 m/min. which is about 107% of the peripheral speed of the rotary casting wheel. The cast billet was examined but no internal cracking of the solidification shell was observed.

As will be seen from the foregoing description, according to the invention, there is provided a continuous casting method in which tension is applied to the cast billet which is being pulled out of the moving mould cavity, so that the cast billet is held in good contact with the rotary casting wheel so that the undesirable fluctuation of the thickness of solidification shell is obviated to eliminate the cracking in the solidification shell during pulling out of the case billet from the moving mould cavity.

What is claimed is:

1. A continuous casting method comprising the steps of:

pouring a molten metal into the entrance of a moving arcuate mould cavity which is formed between a rotary casting wheel having a peripheral casting groove on its outer periphery and a belt covering a part of said peripheral casting groove, cooling the metal within the moving arcuate mold cavity so that it forms a casting which is solidified at its surfaces and has a molten core at the exit of the moving arcuate mould cavity; and continuously pulling out while imparting a tension to the casting from said moving mould cavity by means of pinch rollers which are operated at a peripheral speed the peripheral speed 102 to 110 percent of said rotary casting mould so as to bend the casting from its arcuate shape at the exit of the moving arcuate mould cavity to a linear shape while the tension presses the casting into the surface of the bottom of the casting groove to improve heat transfer.

2. A continuous casting method as claimed in claim 1, wherein the peripheral speed of said pinch rollers is selected to range between 103 and 108% of the peripheral speed of said rotary casting wheel.

3. A continuous casting method as claimed in claim 1, wherein said molten metal is a molten iron alloy.

4. A continuous casting method as claimed in claim 1, wherein said molten metal is a molten iron alloy which has from $\delta$ to $\gamma$ transformation.

5. A continuous casting method as claimed in claim 1, wherein said molten metal is a molten steel which has from $\delta$ to $\gamma$ transformation.

6. A continuous casting method as claimed in claim 1, wherein said molten metal is a molten carbon steel having a carbon content ranging between 0.10 and 0.5 wt. %.

7. A continuous casting method as claimed in claim 1, wherein the driving torques of each of the motor for driving said rotary casting wheel and said pinch rollers are detected from the electric currents supplied to said motors, and the currents supplied to said each of the motors are adjusted to maintain a predetermined relationship between said driving torques thereby to control the peripheral speed of said pinch rollers.

8. A continuous casting method comprising the steps of:

pouring a molten iron alloy into the entrance of a moving arcuate mould cavity formed between a rotary casting wheel having a peripheral casting groove on its outer periphery and a belt covering a part of said peripheral casting groove;

cooling the iron alloy within the moving arcuate mould cavity so that it forms a casting which is solidified at its surfaces and has a molten core at the exit of the moving arcuate mould cavity; and continuously pulling out while imparting a tension to the casting from said moving mould cavity by means of pinch rollers which are operated at a peripheral speed ranging between 103 and 108% of the peripheral speed of said rotary casting wheel, so as to bend the casting from its arcuate shape at the exit of the moving arcuate mould cavity to a linear shape while the tension presses the casting into the surface of the bottom of the cavity groove to improve heat transfer.

9. A casting method as claimed in claim 8, wherein said iron alloy has from δ to γ transformation.

10. A continuous casting method according to claim 9, wherein the driving torques of each of the motors for driving said rotary casting wheel and said pinch rollers are detected from the electric currents supplied to said motors, and the currents supplied to said each of the motors are adjusted to maintain a predetermined relationship between said driving torques thereby to control the peripheral speed of said pinch rollers.

11. A continuous casting method as claimed in claim 8, wherein the driving torques of each of the motors for driving said rotary casting wheel and said pinch rollers are detected from the electric currents supplied to said motors, and the currents supplied to said each of the motors are adjusted to maintain a predetermined relationship between said driving torques thereby to control the peripheral speed of said pinch rollers.

12. A continuous casting method as claimed in claim 11, wherein said molten metal is a molten steel which has from δ to γ transformation.

13. A continuous casting method as claimed in claim 12, wherein said molten metal is a molten carbon steel having a carbon content ranging between 0.10 and 0.5%.

14. A continuous casting method as claimed in claim 8, wherein said molten metal is a molten steel which has from δ to γ transformation.

15. A continuous casting method as claimed in claim 14, wherein said molten metal is a molten carbon steel having a carbon content ranging between 0.10 and 0.5%.

* * * * *